US010856088B2

(12) United States Patent
Vendelbo

(10) Patent No.: US 10,856,088 B2
(45) Date of Patent: Dec. 1, 2020

(54) HEARING DEVICES, USER ACCESSORY DEVICES AND METHOD FOR UPDATING A HEARING DEVICE CONFIGURATION

(71) Applicant: GN HEARING A/S, Ballerup (DK)

(72) Inventor: Allan Munk Vendelbo, Ballerup (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 15/811,677

(22) Filed: Nov. 14, 2017

(65) Prior Publication Data

US 2018/0167746 A1 Jun. 14, 2018

(30) Foreign Application Priority Data

Dec. 8, 2016 (EP) ..... 16202920

(51) Int. Cl.
*H04R 25/00* (2006.01)

(52) U.S. Cl.
CPC ..... *H04R 25/505* (2013.01); *H04R 25/70* (2013.01); *H04R 2225/55* (2013.01)

(58) Field of Classification Search
CPC ..... H04R 25/00; H04R 1/10; H04R 29/00; H04R 31/00; H04R 3/00; H04R 5/033
USPC ..... 381/60, 312, 314, 315
See application file for complete search history.

(56) References Cited

U.S. PATENT DOCUMENTS

2002/0054689 A1* 5/2002 Zhang ..... H04R 25/70 381/312
2004/0162980 A1* 8/2004 Lesenne ..... H04L 63/0442 713/153
2004/0162982 A1* 8/2004 Komai ..... G06F 21/31 713/168
2008/0020707 A1* 1/2008 Takayama ..... H04L 63/045 455/41.2
2010/0306525 A1* 12/2010 Ferguson ..... H04L 63/0442 713/151
2013/0042117 A1* 2/2013 Birtwhistle ..... H04L 63/0823 713/182
2014/0211973 A1* 7/2014 Wang ..... H04W 8/005 381/315

(Continued)

FOREIGN PATENT DOCUMENTS

WO 2012109640 A2 8/2012
WO 2016078710 A1 5/2016

OTHER PUBLICATIONS

European Search Report dated Feb. 17, 2017 for EP Appln. No. 16202920.1.

*Primary Examiner* — Fan S Tsang
*Assistant Examiner* — Julie X Dang
(74) *Attorney, Agent, or Firm* — Vista IP Law Group, LLP

(57) ABSTRACT

This disclosure provides a method, performed at a hearing device, for updating a hearing device configuration at the hearing device of a hearing system. The hearing system comprises the hearing device, a fitting device configured to be controlled by a dispenser and a server device. The method comprises receiving a configuration package and a configuration authentication package, the configuration authentication package comprising a dispenser certificate. The method comprises determining if an update criterion is fulfilled. The update criterion is based on verifying the configuration authentication package. The method comprises updating the hearing device configuration based on the configuration package if the update criterion is fulfilled.

21 Claims, 7 Drawing Sheets

(56) References Cited

U.S. PATENT DOCUMENTS

| | | | | |
|---|---|---|---|---|
| 2016/0173278 | A1 | 6/2016 | Pedersen et al. | |
| 2017/0180886 | A1* | 6/2017 | Van Der Loo ..... | H04W 12/06 |

* cited by examiner

HEARING DEVICES, USER ACCESSORY DEVICES AND METHOD FOR UPDATING A HEARING DEVICE CONFIGURATION

RELATED APPLICATION DATA

This application claims priority to, and the benefit of, European Patent Application No. 16202920.1, filed on Dec. 8, 2016. The entire disclosure of the above application is expressly incorporated by reference herein.

FIELD

The present disclosure relates to a hearing system comprising a server device, a hearing device, and a user accessory device. In particular, the present disclosure relates to methods for updating the hearing device configuration, related hearing devices, and related user accessory devices.

BACKGROUND

Wireless communication to and from different entities of a hearing system has been increasing in continuation of the developments within wireless communication technology. However, the new technologies entail new challenges for the hearing aid manufacturers in order to secure communication in a hearing system. Wireless communication interfaces of a hearing system desirably use an open standard-based interface. However, this poses many challenges in terms of security. Further, a hearing device is a very small device with strict constraints in terms of computational power, memory space etc.

SUMMARY

There is a need for hearing devices, user accessory devices, and methods that provide an improved and effective security supporting an updating of the hearing device configuration, e.g. a remote fitting or a remote fine-tuning of the hearing device. Further, there is a need for devices and methods reducing the risk that the hearing device performs an update using configuration data being compromised by a third (unauthorized) party.

It is an object of this disclosure to provide a method, performed at a hearing device, for updating a hearing device configuration at the hearing device of a hearing system. The hearing system comprises the hearing device, a fitting device configured to be controlled by a dispenser and a server device. The method comprises receiving a configuration package and a configuration authentication package, the configuration authentication package comprising a dispenser certificate. The method comprises determining if an update criterion is fulfilled. The update criterion is based on verifying the configuration authentication package. The method comprises updating the hearing device configuration based on the configuration package if the update criterion is fulfilled.

This disclosure relates to a method performed at a user accessory device, for remote configuration of a hearing device in a hearing system. The method may be performed at a user application installed on the user accessory device. The hearing system comprises the hearing device associated with the user accessory device, the user accessory device, a fitting device, and a server device. The user accessory device is associated, paired, or coupled with the hearing device, such as wirelessly coupled. The method comprises receiving one or more of a configuration verification package, a configuration authentication package, and a configuration package from the server device. The configuration package comprises a configuration payload block and a control block (such as metadata). The method comprises determining if a verification criterion is fulfilled. The verification criterion is based at least on verifying one of the configuration verification package, the configuration authentication package, and the configuration package. The method comprises transmitting the configuration authentication package and/or the configuration package to the hearing device if the verification criterion is fulfilled.

This disclosure relates to a hearing device comprising a processor configured to compensate for a hearing loss of a user based on a hearing device configuration; an interface; and a memory unit. The hearing device is configured to perform the method disclosed herein.

This disclosure relates to a user application configured to be installed on a user accessory device of a hearing system. The user accessory device comprises a processing unit; a memory unit; and an interface. The user application, when installed on the user accessory device is configured to perform the method disclosed herein.

This disclosure relates to a user accessory device of a hearing system. The user accessory device comprises a processing unit; a memory unit; and an interface. The user accessory device is configured to perform the method disclosed herein.

It is an advantage of the present disclosure that the disclosed hearing device and the disclosed use accessory device support a secure remote configuration or remote tuning that is compliant with the limited computational power of the hearing device.

A method, performed at a hearing device, for updating a hearing device configuration at the hearing device, the hearing device being configurable by a fitting device, includes: receiving a configuration package and a configuration authentication package, the configuration authentication package comprising a dispenser certificate; determining if an update criterion is fulfilled, wherein the act of determining comprises verifying the configuration authentication package; and updating the hearing device configuration based on the configuration package if the update criterion is fulfilled.

Optionally, the configuration package and the configuration authentication package are received from a user accessory device.

Optionally, the act of determining if the update criterion is fulfilled comprises verifying the dispenser certificate.

Optionally, the act of verifying the dispenser certificate comprises decrypting the dispenser certificate using a certificate key.

Optionally, the configuration authentication package further comprises authentication data; and wherein the act of verifying the dispenser certificate comprises comparing one or more elements of the authentication data with corresponding element(s) of the dispenser certificate, and wherein the act of verifying the dispenser certificate fails if at least one of the one or more elements of the authentication data does not match the corresponding element of the dispenser certificate.

Optionally, the act of verifying the dispenser certificate comprises decrypting the dispenser certificate using a certificate key, and wherein the act of comparing the one or more elements of the authentication data with the corresponding element(s) of the dispenser certificate comprises comparing the one or more elements of the authentication data received in plain text with the corresponding element(s) of the decrypted dispenser certificate.

Optionally, the act of verifying the dispenser certificate comprises determining if the fitting device and/or a dispenser is blacklisted.

Optionally, the act of updating the hearing device configuration based on the configuration package comprises decrypting the configuration package using a configuration session key.

Optionally, the configuration package comprises a configuration data integrity indicator, and wherein the act of updating the hearing device configuration comprises verifying the configuration data integrity indicator; and wherein the method further comprises terminating the act of updating if the act of verifying the configuration data integrity indicator fails.

Optionally, the hearing device is a hearing aid.

A method, performed at a user accessory device, for remote configuration of a hearing device, includes: receiving a configuration verification package, a configuration authentication package, a configuration package, or any combination of the foregoing, from a server device, wherein the configuration package comprises a configuration payload block and a control block; determining if a verification criterion is fulfilled based on the configuration verification package, the configuration authentication package, the configuration package, or any combination of the foregoing; and transmitting the configuration authentication package and/or the configuration package to the hearing device if the verification criterion is fulfilled.

Optionally, the configuration authentication package comprises a digital signature; and wherein the act of determining if the verification criterion is fulfilled is performed based on the digital signature.

Optionally, the configuration verification package comprises an integrity indicator set and/or a digital signature, and wherein the act of determining if the verification criterion is fulfilled comprises: verifying the digital signature; and/or verifying the integrity indicator set.

Optionally, the configuration verification package and/or the configuration authentication package comprise a hearing device identifier and/or an address identifier, and wherein the act of determining if the verification criterion is fulfilled comprises: performing a first verification based on the hearing device identifier, the hearing device identifier associated with the hearing device; and/or performing a second verification based on the address identifier, the address identifier associated with the hearing device.

Optionally, the hearing device comprises a hearing aid.

A hearing device includes: a processor configured to compensate for a hearing loss of a user based on a hearing device configuration; wherein the hearing device is configured to receive a configuration package and a configuration authentication package, the configuration authentication package comprising a dispenser certificate; determine if an update criterion is fulfilled based on the configuration authentication package; and update the hearing device configuration based on the configuration package if the update criterion is fulfilled.

A program product includes a set of instructions, an execution of which by a processing unit of a user accessory device causes a method to be performed, the method comprising: receiving a configuration verification package, a configuration authentication package, a configuration package, or any combination of the foregoing, from a server device, wherein the configuration package comprises a configuration payload block and a control block; determining if a verification criterion is fulfilled based on the configuration verification package, the configuration authentication package, the configuration package, or any combination of the foregoing; and transmitting the configuration authentication package and/or the configuration package to a hearing device if the verification criterion is fulfilled.

Thus, the present disclosure advantageously provides methods, related hearing devices, related user applications, and related user accessory devices that enable an effective and secure remote configuration of the hearing device.

BRIEF DESCRIPTION OF THE DRAWINGS

The above and other features and advantages of the present disclosure will become readily apparent to those skilled in the art by the following detailed description of exemplary embodiments thereof with reference to the attached drawings, in which.

DETAILED DESCRIPTION

Figure 1:
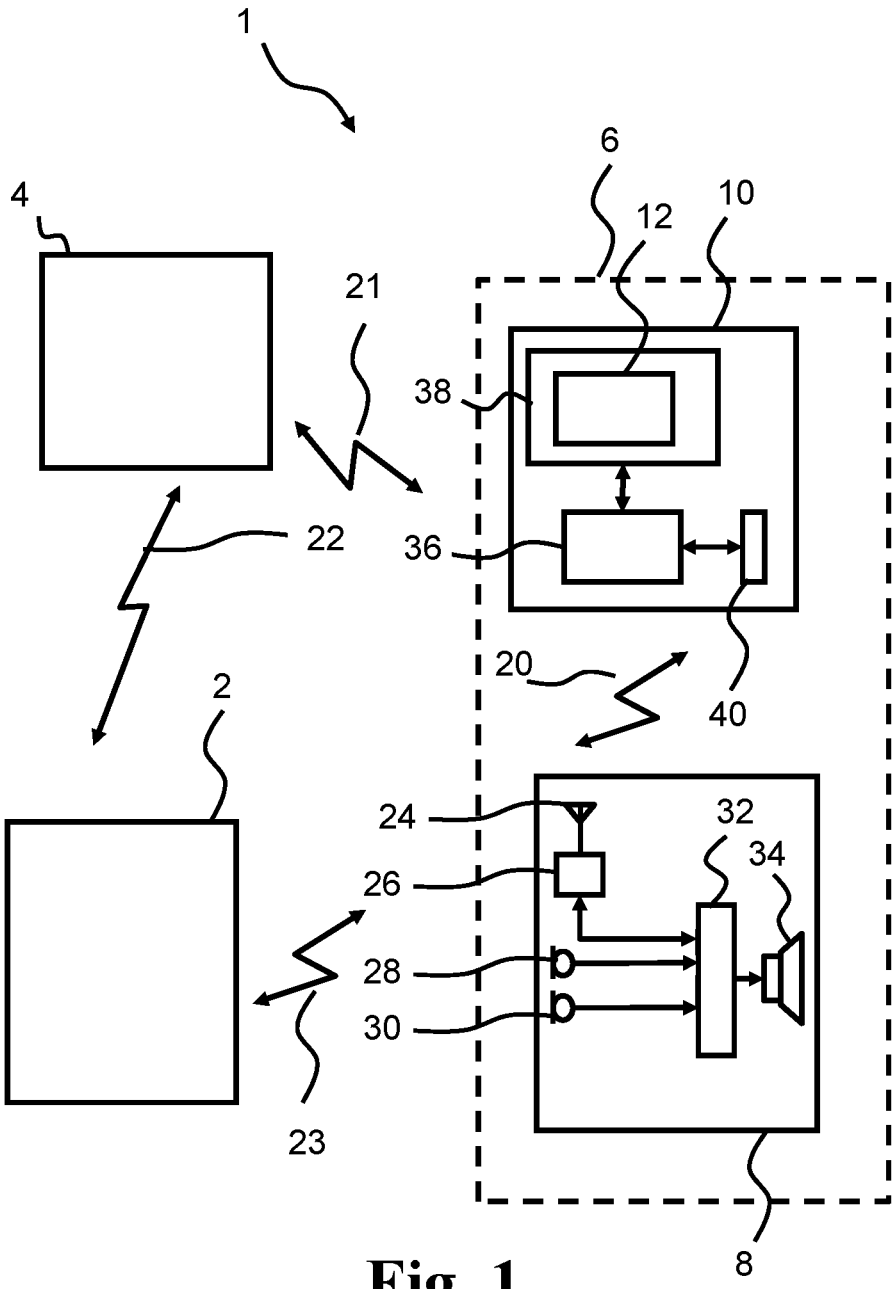
FIG. 1. schematically illustrates a hearing system.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to enabling and securing a remote updating or configuring of a hearing device in a hearing system. The hearing system comprises a server device, a hearing device, a user accessory device and a fitting device. The fitting device is controlled by a dispenser and is configured to determine the configuration data, such as fitting parameters. The server device may be controlled by the hearing device manufacturer. The server device may be a distributed server device, i.e. a server device with distributed processors. Namely, the methods, hearing devices, user accessory devices, and user applications disclosed herein enable a remote configuration of the hearing device by the fitting device, where the remote configuration is robust against security threats, vulnerabilities and attacks by implementing appropriate safeguards and countermeasures, such as security mechanisms, to protect against threats and attacks. The present disclosure relates to a method for updating a hearing device configuration, which is robust against replay attacks, unauthorized access, battery exhaustion attacks, and man-in-the-middle attacks.

The present disclosure addresses a situation that is encountered by dispensers and hearing device users. This can be illustrated in the following example. A hearing device user calls a dispenser (e.g. from home) and complains about the configuration or fitting done earlier at the professional dispenser's office. To avoid having the user come back to the dispenser's office for a configuration again, the inventors propose to have dispenser adjust certain configuration values (e.g. +3 db gain at 1 kHz) in the office and send the resulting configuration package—or fine tuning package—to the hearing device or a user accessory having an application installed thereon to handle the hearing device. The hearing device user is able to use the application to download the configuration package and apply it to the hearing device. However, such a retrieval of the configuration package shall be secured, the configuration package shall be integrity protected, and the entire chain of processing leading to the installation of the configuration package on the hearing device shall be confidential, authenticated and integrity protected.

The present disclosure relates to hearing system communication between entities of a hearing system. The user accessory device forms an accessory device to the hearing device. The user accessory device is typically paired or wirelessly coupled to the hearing device. The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. Typically, the hearing device system is in possession of and controlled by the hearing device user. The user accessory device may be a hand-held device, such as smartphone, a smartwatch, or a tablet computer.

As used herein the term "identifier" refers to a piece of data that is used for identifying, such as for categorizing, and/or uniquely identifying. The identifier may be in a form of a word, a number, a letter, a symbol, a list, an array or any combination thereof. For example, the identifier as a number may be in the form of an integer, such as unsigned integer, unit, with a length, or more, such as an array of unsigned integers. An identifier may have a length of several bytes. For example, a hearing device identifier may have a length of 20 bytes.

The present disclosure relates to a method performed at a hearing device, for updating a hearing device configuration at the hearing device of a hearing system. The hearing system comprises the hearing device, a fitting device configured to be controlled by a dispenser and a server device. The method comprises receiving a configuration package and a configuration authentication package, such as receiving at the hearing device the configuration package and the configuration authentication package. The configuration authentication package comprises a dispenser certificate. The method comprises determining if an update criterion is fulfilled. The update criterion is based on verifying the configuration authentication package. The method comprises updating the hearing device configuration based on the configuration package if the update criterion is fulfilled. The configuration package comprises configuration data, such as data related to the hearing device. The data related to the hearing device may comprise hearing device settings and/or fitting parameters.

In one or more exemplary methods performed at the hearing device, the hearing system comprises a user accessory device. Receiving the configuration package and the configuration authentication package may comprise receiving the configuration package and the configuration authentication from the user accessory device or from a user application installed on the user accessory device. The user accessory device may have received the configuration package and the configuration authentication package from the fitting device and/or from the server device.

In one or more exemplary methods performed at the hearing device, determining if the update criterion is fulfilled comprises verifying the dispenser certificate, and the update criterion is not fulfilled if verifying the dispenser certificate fails. In other words, the update criterion is based on verifying the dispenser certificate included in the configuration authentication package and the update criterion is fulfilled if verifying the dispenser certificate succeeds. Verifying the dispenser certificate comprises verifying that the dispenser certificate is valid, and when it is verified that the dispenser certificate is valid, the exemplary method may comprise proceeding to updating the hearing device configuration based on the configuration package.

In one or more exemplary methods performed at the hearing device, verifying the dispenser certificate comprises decrypting the dispenser certificate using a certificate key. In other words, the configuration authentication package may comprise the dispenser certificate in encrypted form, which requires the hearing device to be configured to decrypt the received dispenser certificate using the certificate key. In one or more exemplary methods performed at the hearing device, verifying the dispenser certificate comprises deriving the certificate key based on keying material from a memory unit of the hearing device and/or material from the configuration authentication package. Deriving the certificate key may comprise obtaining a common secret from e.g. a memory unit of the hearing device, and calculating the certificate key based on the common secret. For example, obtaining the common secret may comprise retrieving the common secret from memory unit of the hearing device using a common secret identifier provided in the configuration authentication package and computing the certificate key based on the common secret and possibly a base key. Alternatively or additionally, obtaining the common secret may comprise retrieving keying material using an identifier provided in the configuration authentication package and computing the common secret based on the retrieved keying material and random data.

In one or more exemplary methods performed at the hearing device, the configuration authentication package further comprises authentication data. Verifying the dispenser certificate may comprise comparing one or more elements of the authentication data with corresponding elements of the dispenser certificate, and verifying the dispenser certificate fails if at least one elements of the authentication data does not match the corresponding element of the dispenser certificate. Stated differently, the update criterion may not be fulfilled if at least one element of the authentication data does not match the corresponding element of the dispenser certificate, which results in the update not been triggered. Comparing one or more elements of the authentication data with corresponding elements of the dispenser certificate may comprise comparing one or more elements of the authentication data received in plain text with corresponding elements of the decrypted dispenser certificate. For example, the authentication data comprises a fitting type identifier received in plain text, and a fitting key identifier received in plain text while the decrypted dispenser certificate comprises a fitting type identifier and, a fitting key identifier. In this example, the hearing device compares the fitting type identifier received in plain text with the fitting type identifier of the decrypted dispenser certificate, and a fitting key identifier received in plain text with the fitting key identifier of the dispenser certificate. In this example, if the hearing device identifies a mismatch between the fitting type identifier received in plain text with the fitting type identifier of the decrypted dispenser certificate, and/or between a fitting key identifier received in plain text with the fitting key identifier of the dispenser certificate, the update criterion is not fulfilled and the update is aborted.

In one or more exemplary methods performed at the hearing device, verifying the dispenser certificate comprises determining if the fitting device and/or the dispenser is blacklisted, and verifying the dispenser certificate fails if the fitting device and/or the dispenser is blacklisted. For example, determining if the fitting device and/or the dispenser is blacklisted is performed using a blacklist comprising an identifier of a fitting device and/or the dispenser that has been excluded from the hearing system. The blacklist serves as a mitigation tool, for preventing attacks using lost credentials. The one or more exemplary methods performed at the hearing device may comprise verifying a certificate type identifier of the dispenser certificate. Certain hearing device can only accept configuration package from certain types of fitting devices.

In one or more exemplary methods performed at the hearing device, updating the hearing device configuration based on the configuration package comprises decrypting the configuration package using a configuration session key. For example, updating the hearing device configuration based on the configuration package may comprise deriving the configuration session key based on a base key stored in the memory unit of the hearing device. The base key may be shared or common with the server device.

In one or more exemplary methods performed at the hearing device, the configuration package comprises a configuration data integrity indicator, and updating the hearing device configuration comprises verifying the configuration data integrity indicator based on the configuration package, and terminating or aborting the update of the hearing device configuration based on the configuration package if the verification of the configuration data integrity indicator fails. The configuration data integrity indicator may be computed over the configuration data, e.g. using SHA1 or SHA2. If the verification of the configuration data integrity indicator succeeds, the update proceeds to storing the configuration data comprised in the configuration package. This supports protecting the hearing device from accepted configuration data that has been tampered with.

In one or more exemplary methods performed at the hearing device, the hearing device is a hearing aid, configured to compensate for hearing loss of a user.

This disclosure relates to a hearing device comprising a processor configured to compensate for a hearing loss of a user based on a hearing device configuration; an interface; and a memory unit. The hearing device is configured to perform the method disclosed herein.

This disclosure relates to a method performed at a user accessory device, for remote configuration of a hearing device in a hearing system. The method may be performed at a user application installed on the user accessory device. The user application is, when installed on the user accessory device, configured to perform the method disclosed herein as performed at the user accessory device. The hearing system comprises the hearing device associated with the user accessory device, the user accessory device, a fitting device, and a server device. The user accessory device is associated, paired, or coupled with the hearing device, such as wirelessly coupled. The method comprises receiving one or more of a configuration verification package, a configuration authentication package, and a configuration package from the server device, e.g. via communication link 21. The configuration package comprises a configuration payload block and a control block (such as metadata).

The method comprises determining if a verification criterion is fulfilled. The verification criterion is based at least on verifying one of the configuration verification package, the configuration authentication package, and the configuration package.

The method comprises transmitting the configuration authentication package and/or the configuration package to the hearing device, via e.g. a wireless communication link if the verification criterion is fulfilled. The method may comprise transmitting the configuration package to the hearing device only if or after the configuration authentication package is successfully verified. The method may comprise omitting to transmit any of the configuration authentication package and the configuration package to the hearing device if the verification criterion is not fulfilled.

In one or more exemplary methods performed at the user accessory device, the configuration authentication package comprises a second digital signature; and the verification criterion comprises a first verification criterion based on verifying the second digital signature. In one or more exemplary methods performed at the user accessory device, the verification criterion is not fulfilled if the first verification criterion is not fulfilled. In other words, the verification criterion may be fulfilled if the first verification criterion is fulfilled. Verifying the second digital signature may be performed using a configuration public key, which may be stored in the memory unit of the user accessory device.

In one or more exemplary methods performed at the user accessory device, the configuration verification package comprises an integrity indicator set and/or a first digital signature, and the verification criterion comprises a second verification criterion comprising a second primary verification criterion and a second secondary verification criterion. The integrity indicator set may comprise a first integrity indicator, a second integrity indicator, and optionally a third integrity indicator. The second primary verification criterion may be based on verifying the first digital signature, such as using the configuration public key. The second secondary verification criterion may be based on verifying the integrity indicator set, e.g. based on the configuration payload block, and the control block, such as by calculating a first configuration data integrity indicator over the configuration payload block and comparing the calculated first configuration data integrity indicator with the received first integrity indicator of the integrity indicator set and/or by calculating a second configuration data integrity indicator over the control block and comparing the calculated second configuration data integrity indicator with the received second integrity indicator of the integrity indicator set. The verification criterion may not be fulfilled if the second primary verification criterion or the second secondary verification criterion is not fulfilled. In other words, the verification criterion may be fulfilled if the second primary verification criterion and the second secondary verification criterion are fulfilled.

In one or more exemplary methods performed at the user accessory device, the configuration verification package, and/or the configuration authentication package, comprise a hearing device identifier and/or an address identifier. The verification criterion may comprise a third verification criterion based on the received hearing device identifier corresponding to a hearing device identifier of the hearing device associated with the user accessory, such as based on verifying whether the received hearing device identifier corresponds to the hearing device identifier of the hearing device associated with the user accessory. Alternatively or additionally, the verification criterion may comprise a fourth verification criterion based on the received address identifier corresponding to an address identifier of the hearing device associated with the user accessory, e.g. based on verifying whether the received address identifier corresponds to an address identifier of the hearing device associated with the user accessory. The verification criterion may not be fulfilled if the third verification criterion or the fourth verification criterion is not fulfilled. In other words, the verification criterion may be fulfilled if the third verification criterion and the fourth verification criterion are fulfilled.

In one or more exemplary methods performed at the user accessory device, the verification criterion is not fulfilled if the first verification criterion, or the second primary verification criterion, or the second secondary verification criterion, or the third verification criterion or the fourth verification criterion is not fulfilled.

In one or more exemplary methods performed at the user accessory device, the verification criterion is fulfilled if the first verification criterion, and the second primary verification criterion, and the second secondary verification criterion, and the third verification criterion and the fourth verification criterion are fulfilled.

This disclosure relates to a user application configured to be installed on a user accessory device of a hearing system. The user accessory device comprises a processing unit; a memory unit; and an interface. The user application, when installed on the user accessory device, is configured to perform the method disclosed herein.

This disclosure relates to a user accessory device of a hearing system. The user accessory device comprises a processing unit; a memory unit; and an interface. The user accessory device is configured to perform the method disclosed herein.

FIG. 1 shows an exemplary hearing system 1. The hearing system 1 comprises a server device 4, a fitting device 2 and a hearing device 8 and an accessory device 10. It may be envisaged that the hearing device 8 and the accessory device 10 form part of a hearing device system 6. The user accessory device 10 is a handheld device such as smartphone configured to wirelessly communicate with the hearing device 8. A user application 12 is installed on the user accessory device 10. The user application may be for controlling the hearing device 8 and/or assisting a hearing device user wearing/using the hearing device 8. In one or more exemplary user applications, the user application 12 is configured to transfer configuration data (e.g. hearing device settings or fitting parameters), to the hearing device. The user accessory device 10 comprises a processing unit 36, a memory unit 38, and an interface 40. The user application 12 may be installed in the memory unit 38 of the user accessory device 10.

The hearing device 8 comprises an antenna 24 and a radio transceiver 26 coupled to the antenna 24 for receiving/transmitting wireless communication including first communication link 20. The hearing device 8 comprises a set of microphones comprising a first microphone 28 and optionally a second microphone 30 for provision of respective first and second microphone input signals. The hearing device 8 may be a single-microphone hearing device. The hearing device 8 comprises a memory unit (not shown) connected to the processor 32, wherein configuration data, e.g. configuration or hearing device settings are stored in the memory unit.

The hearing device 8 comprises a processor 32 connected to the transceiver 26 and microphones 28, 30 for receiving and processing input signals. The processor 32 is configured to compensate for a hearing loss of a user based on hearing device settings and to provide an electrical output signal based on the input signals. A receiver 34 converts the electrical output signal to an audio output signal to be directed towards an eardrum of the hearing device user.

The fitting device 2 is capable of communicating with the server device 4 through communication link 22, and with the hearing device system 6 through communication link 23. In an embodiment, the fitting device is configured to communicate with the accessory device 10 via communication link 23. The hearing device 8 is capable of communicating with the user accessory device 10 through communication link 20. The user accessory device 10 may be configured to communication with the server device 4 via communication link 21. A communication link may comprise a wireless communication link and/or a wired communication link.

Figure 2:
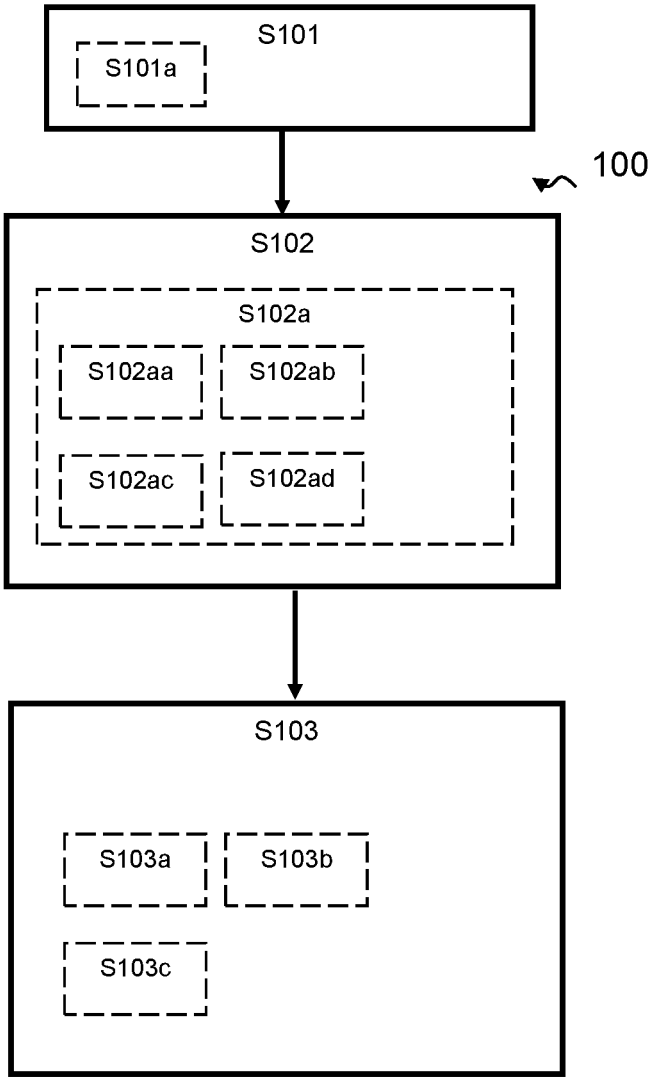
FIG. 2. is a flow diagram of an exemplary method performed at a hearing device according to this disclosure, FIG. 3. is a flow diagram of an exemplary method performed at a user accessory device, or a user application installed thereon, according to this disclosure, FIG. 4. schematically illustrates an exemplary configuration package, and an exemplary configuration verification package according to this disclosure, FIG. 5. schematically illustrates an exemplary configuration authentication package according to this disclosure, FIG. 6. schematically illustrates an exemplary hearing device according to this disclosure, and FIG. 7. schematically illustrates an exemplary user accessory device according to this disclosure.

FIG. 2 shows a flow diagram of an exemplary method 100 performed at a hearing device (such as hearing device 8 of FIG. 1) according to this disclosure. The method 100 aims at updating a hearing device configuration at the hearing device of a hearing system, e.g. based on receiving a configuration package that has been prepared by a dispenser remotely. The method 100 comprises receiving S101 a configuration package and a configuration authentication package, the configuration authentication package comprising a dispenser certificate. The method 100 comprises determining S102 if an update criterion is fulfilled. The update criterion is based on verifying the configuration authentication package. The method 100 comprises updating S103 the hearing device configuration based on the configuration package if the update criterion is fulfilled.

In one or more exemplary methods, the hearing system comprises a user accessory device. Receiving S101 the configuration package and the configuration authentication package may comprise receiving S101*a* the configuration package and the configuration authentication from the user accessory device or from a user application installed on the user accessory device, via communication link 20.

In one or more exemplary methods performed at the hearing device, determining S102 if the update criterion is fulfilled comprises verifying S102*a* the dispenser certificate, and the update criterion is not fulfilled if verifying the dispenser certificate fails.

In one or more exemplary methods performed at the hearing device, verifying S102*a* the dispenser certificate comprises decrypting S102*a* a the dispenser certificate using a certificate key. In one or more exemplary methods performed at the hearing device, verifying S102*a* the dispenser certificate comprises deriving S102*ab* the certificate key based on keying material from a memory unit of the hearing device and/or material from the configuration authentication package. Deriving S102*ab* the certificate key may comprise obtaining a common secret from e.g. a memory unit of the hearing device, and calculating the certificate key based on the common secret. For example, obtaining the common secret may comprise retrieving the common secret from memory unit of the hearing device using a common secret identifier provided in the configuration authentication package and computing the certificate key based on the common secret and possibly a base key. Alternatively or additionally, obtaining the common secret may comprise retrieving keying material using an identifier provided in the configuration authentication package and computing the common secret based on the retrieved keying material and random data.

In one or more exemplary methods performed at the hearing device, the configuration authentication package further comprises authentication data. Verifying S102*a* the dispenser certificate may comprise comparing S102*ac* one or more elements of the authentication data with corresponding elements of the dispenser certificate, and verifying the dispenser certificate fails if at least one elements of the authentication data does not match the corresponding element of the dispenser certificate. Comparing S102*ac* one or more elements of the authentication data with corresponding elements of the dispenser certificate may comprise comparing one or more elements of the authentication data received in plain text with corresponding elements of the decrypted dispenser certificate.

In one or more exemplary methods performed at the hearing device, verifying S102*a* the dispenser certificate comprises determining S102*ad* if the fitting device and/or the dispenser is blacklisted, and verifying the dispenser certificate fails if the fitting device and/or the dispenser is blacklisted. For example, determining S102*ad* if the fitting device and/or the dispenser is blacklisted is performed using a blacklist comprising an identifier of a fitting device and/or the dispenser that has been excluded from the hearing system.

In one or more exemplary methods performed at the hearing device, updating S103 the hearing device configuration based on the configuration package comprises decrypting S103*a* the configuration package using a configuration session key. For example, updating S103 the hearing device configuration based on the configuration package may comprise deriving S103*b* the configuration session key based on a base key stored in the memory unit of the hearing device. The base key may be shared or common with the server device.

In one or more exemplary methods performed at the hearing device, the configuration package comprises a configuration data integrity indicator, and updating S103 the hearing device configuration comprises verifying S103*c* the configuration data integrity indicator based on the configuration package, and terminating or aborting the update of the hearing device configuration based on the configuration package if the verification of the configuration data integrity indicator fails.

In one or more exemplary methods performed at the hearing device, method 100 may comprise storing and/or applying the configuration data to the hearing device when the update criterion is fulfilled.

Figure 3:
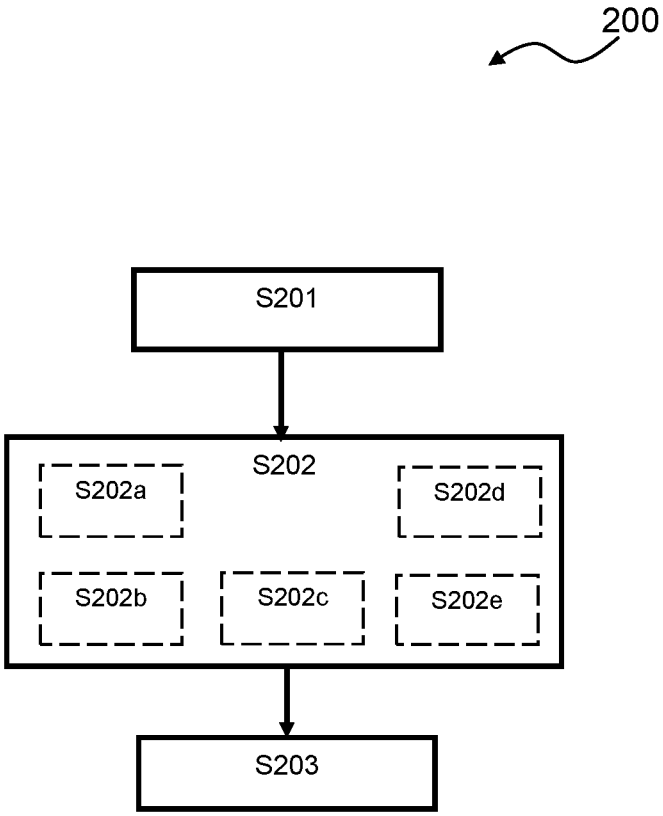

FIG. 3 shows a flow diagram of an exemplary method 200 performed at a user accessory device (such as device 10 of FIG. 1) or at a user application installed on the user accessory device according to this disclosure. Method 200 method aims at supporting a remote configuration of a hearing device in a hearing system. The method may be performed at a user application installed on the user accessory device. The user application is, when installed on the user accessory device, configured to perform the method 200. Method 200 comprises receiving S201 at the hearing device one or more of a configuration verification package, a configuration authentication package, and a configuration package from the server device 4, e.g. via the communication link 21. The configuration package comprises a configuration payload block and a control block (such as metadata). One or more of a configuration verification package, a configuration authentication package, and a configuration package may be received at the user accessory device via the server device 4 from the fitting device 2, e.g. using the communication links 21 and 22.

Method 200 comprises determining S202 if a verification criterion is fulfilled. The verification criterion is based at least on verifying S202*a* one of the configuration verification package, the configuration authentication package, and the configuration package.

Method 200 comprises transmitting S203 the configuration authentication package and/or the configuration package to the hearing device, e.g. via communication link 20, if the verification criterion is fulfilled. The method may comprise transmitting the configuration package to the hearing device only if or after the configuration authentication package is successfully verified. The method may comprise omitting to transmit any of the configuration authentication package and the configuration package to the hearing device if the verification criterion is not fulfilled.

In one or more exemplary methods performed at the user accessory device, the configuration authentication package comprises a second digital signature; and the verification criterion comprises a first verification criterion based on verifying S202*a* the second digital signature. In one or more exemplary methods performed at the user accessory device, the verification criterion is not fulfilled if the first verification criterion is not fulfilled.

In one or more exemplary methods performed at the user accessory device, the configuration verification package comprises an integrity indicator set and/or a first digital signature, and the verification criterion comprises a second verification criterion comprising a second primary verification criterion and a second secondary verification criterion. The integrity indicator set may comprise a first integrity indicator, a second integrity indicator, and optionally a third integrity indicator. The second primary verification criterion may be based on verifying S202*b* the first digital signature, such as using the configuration public key. The second secondary verification criterion may be based on verifying S202*c* the integrity indicator set, e.g. based on the configuration payload block, and the control block, by e.g. calculating a first configuration data integrity indicator over the configuration payload block and comparing the calculated first configuration data integrity indicator with the received first integrity indicator of the integrity indicator set and/or by calculating a second configuration data integrity indicator over the control block and comparing the calculated second configuration data integrity indicator with the received second integrity indicator of the integrity indicator set. The verification criterion may not be fulfilled if the second primary verification criterion or the second secondary verification criterion is not fulfilled.

In one or more exemplary methods performed at the user accessory device, the configuration verification package, and/or the configuration authentication package comprise a hearing device identifier and/or an address identifier. The verification criterion may comprise a third verification criterion based on the received hearing device identifier corresponding to a hearing device identifier of the hearing device associated with the user accessory, such as based on verifying S202*d* whether the received hearing device identifier corresponds to the hearing device identifier of the hearing device associated with the user accessory. Alternatively or additionally, the verification criterion may comprise a fourth verification criterion based on the received address identifier corresponding to an address identifier of the hearing device associated with the user accessory, e.g. based on verifying S202*e* whether the received address identifier corresponds to an address identifier of the hearing device associated with the user accessory. The verification criterion may not be fulfilled if the third verification criterion or the fourth verification criterion is not fulfilled.

Figure 4:
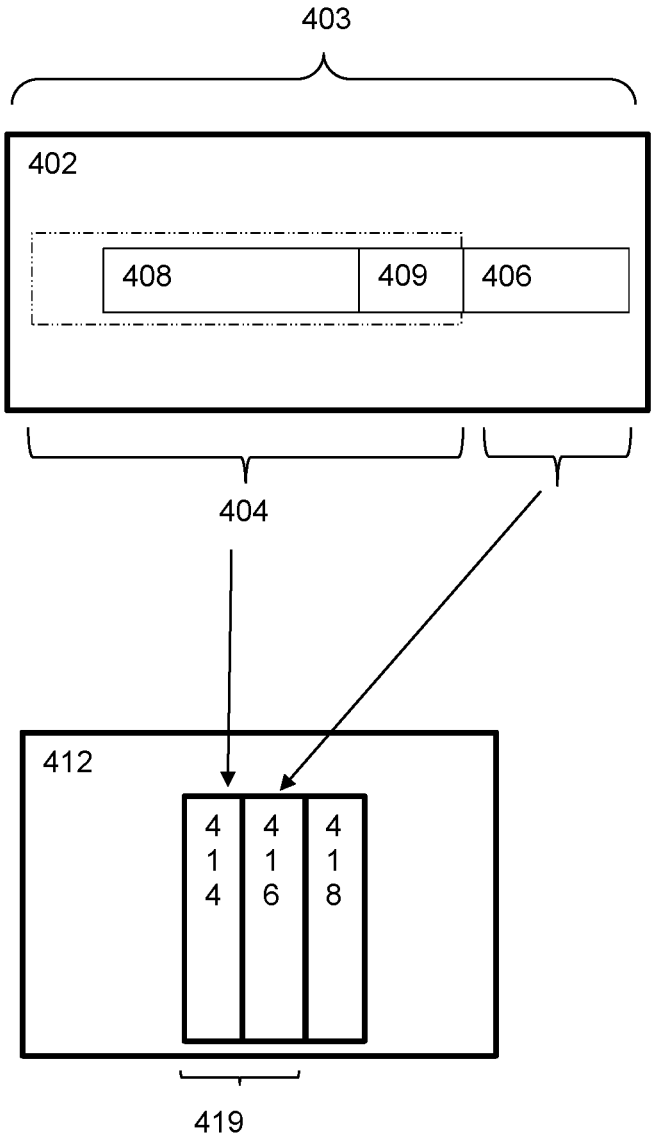

FIG. 4 schematically illustrates an exemplary configuration package 402, and an exemplary configuration verification package 412 according to this disclosure.

The configuration package 402 comprising configuration package data 403. The configuration package data 403 comprises a configuration payload block 404 and a control block 406. The configuration package 402 is generated, by the fitting device in collaboration with the server device, based on configuration data 408 for the hearing device. The configuration package data 403 comprises the configuration data 408, which is the actual fitting parameters or hearing device setting parameters, which are used to configure the hearing device. The configuration data 408 may be included in the configuration package data 403 in encrypted form using a configuration keying material comprising a configuration key. The configuration package data 403 comprises a configuration data integrity indicator 409 computed over the configuration data 408, and included in the configuration package data 403. The configuration payload block 404 comprises the configuration data 408 and the configuration data integrity indicator 409, which are optionally in encrypted form as indicated by the dashed box in FIG. 4. The control block 406 comprises headers, length of the configuration data and/or metadata. The fitting device may be configured to generate the configuration package by encrypting, e.g. using the session key, the configuration package data 403, i.e. the configuration payload block 404 and the control block 406. The configuration package is generated at the fitting device.

The configuration verification package 412 is generated at the server device. The configuration verification package 412 comprises a set of integrity indicators, such as a first integrity indicator 414, a second integrity indicator 416. The server receives a configuration package 402 from the fitting device. The configuration package 402 comprises a configuration payload block 404 and a control block 406. The server generates a configuration block 419 by computing a first integrity indicator 414 based on the configuration payload block 404 and a second integrity indicator 416 based on the control block 406, and by including the first integrity indicator 414 and the second integrity indicator 416 into the configuration block 419. The server device signs the configuration verification package 412 using a configuration private key. The configuration verification package 412 comprises a first digital signature 418. The configuration verification package 412 is used at the user accessory device to verify the configuration package 402 and/or the configuration authentication package 502 before passing the configuration package 402 and/or the configuration authentication package 502 to the hearing device.

Figure 5:
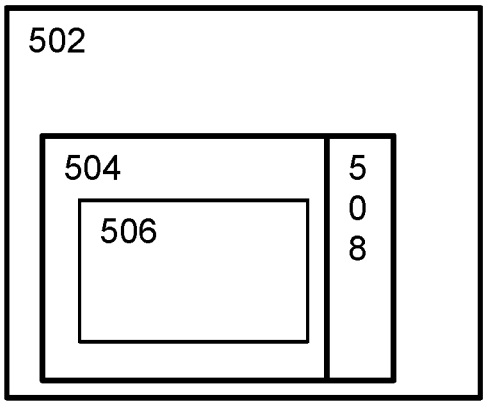

FIG. 5 schematically illustrates an exemplary configuration authentication package 502 according to this disclosure. The configuration authentication package 502 is generated by the server device. The configuration authentication package 502 comprises a configuration authentication material 504. The configuration authentication material 504 comprises a dispenser certificate 506, which may be encrypted using a certificate key. The server obtains a second digital signature 508 over the configuration authentication material 504 using a configuration private key that is stored in the server device and used for configuration purposes. The configuration public key and the certificate key are known to the hearing device. The configuration authentication package 502 comprises the second digital signature 508.

The configuration package 402 and the configuration authentication package 502 are received and processed by the hearing device. The configuration authentication package 502 is generated by the server device so that the hearing device can verify the integrity of the configuration data. The configuration authentication package 502 is used at the hearing device to authenticate the configuration package 402 that actually comprises the fitting parameters or configuration data to be installed on the hearing device.

The configuration verification package 412 is used at the user accessory device to verify the configuration package 402 and/or the configuration authentication package 502. In other words, the dispenser or the fitting device uses the server device to create a configuration authentication package 502 for a specific hearing device, i.e. that can be verified by the specific hearing device. The configuration authentication package 502 and the configuration package data in the configuration package 402 are generated so that the hearing device is able to verify that the configuration package 402 comes from a legitimate dispenser or legitimate fitting device and that the configuration data in the configuration package 402 has not be tampered with nor disclosed by any other party because configuration data is private data that can be used to perform denial of service attack or battery exhaustion attacks on the hearing device.

Figure 6:
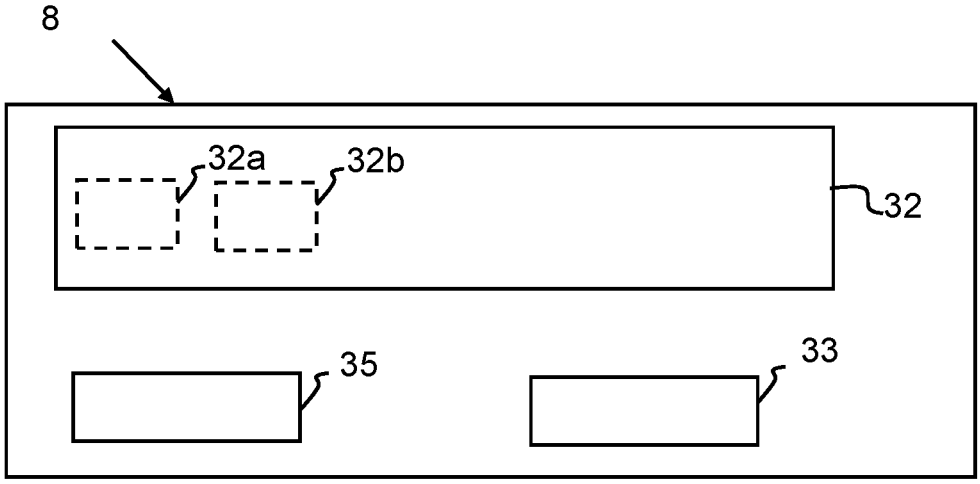

FIG. 6 schematically illustrates an exemplary hearing device 8 according to this disclosure. The hearing device 8 comprises a processor 32 configured to compensate for a hearing loss of a user based on a hearing device configuration; an interface 33; and a memory unit 35. The interface 33 may comprise an antenna (such as antenna 24 of FIG. 1) and a radio transceiver (such as radio transceiver 26 of FIG. 1) coupled to the antenna for receiving/transmitting wireless communication, to and from a user accessory device, and optionally from any of a fitting device and a server device. The hearing device 8 is configured to perform the method 100 disclosed herein in FIG. 2.

The hearing device 8 or the interface 33 is configured to receive, e.g. from a user accessory device or a user application installed thereon, a configuration package and a configuration authentication package, the configuration authentication package comprising a fitting device certificate. The hearing device 8 or the processor 32 is configured to determine if an update criterion is fulfilled, wherein the update criterion is based on verifying the configuration authentication package; and to update the hearing device configuration based on the configuration package if the update criterion is fulfilled.

The processor 32 may be configured to verify the dispenser certificate, and to determine that the update criterion is not fulfilled if verifying the dispenser certificate fails.

The processor 32 may be configured to decrypt the dispenser certificate using a certificate key. In one or more exemplary hearing devices. The processor 32 may be configured to verify the dispenser certificate by deriving the certificate key based on keying material from a memory unit of the hearing device and/or material from the configuration authentication package. The processor 32 may be configured to obtain a common secret from e.g. a memory unit of the hearing device and calculating the certificate key based on the common secret.

In one or more exemplary hearing devices, the configuration authentication package further comprises authentication data. The processor 32 may be configured to verify the dispenser certificate by comparing one or more elements of the authentication data with corresponding elements of the dispenser certificate, and to determine that verifying the dispenser certificate fails if at least one elements of the authentication data does not match the corresponding element of the dispenser certificate. The processor 32 may be configured to compare one or more elements of the authentication data with corresponding elements of the dispenser certificate by comparing one or more elements of the authentication data received in plain text with corresponding elements of the decrypted dispenser certificate.

The processor 32 may be configured to verify the dispenser certificate by determining if the fitting device and/or the dispenser is blacklisted, and to determine that verifying the dispenser certificate fails if the fitting device and/or the dispenser is blacklisted. For example, determining if the fitting device and/or the dispenser is blacklisted is performed using a blacklist comprising an identifier of a fitting device and/or the dispenser that has been excluded from the hearing system.

The processor 32 may be configured to update the hearing device configuration based on the configuration package by decrypting the configuration package using a configuration session key, such as by deriving the configuration session key based on a base key stored in the memory unit 35 of the hearing device. The base key may be shared or common with the server device.

In one or more exemplary hearing devices, the configuration package comprises a configuration data integrity indicator, and the processor 32 may be configured to update the hearing device configuration based on the configuration package by verifying the configuration data integrity indicator based on the configuration package, and by terminating or aborting the update of the hearing device configuration based on the configuration package if the verification of the configuration data integrity indicator fails.

The processor 32 may be configured to update the hearing device configuration based on the configuration package by storing the configuration data in the memory unit 35 in order to apply the stored configuration data to the hearing device for a configuration update.

The hearing device 8 or the processing unit 32 is arranged to execute methods for updating the hearing device configuration as disclosed herein. The hearing device 8 or the processing unit 32 may further comprise a number of optional functional modules, such as any of a determine module 32*a* configured to perform steps S102 and optionally S102*a*, S102*aa-ad*, and an update module 32*b* configured to perform step S103. The functionality of each functional module 32*a-b* is disclosed in the context of which the functional modules 32*a-b* may be used in FIG. 2 and accompanying text. In general terms, each functional module 32*a-b* may be implemented in hardware or in software. Preferably, one, more, or all functional modules 32*a-b* may be implemented by the processing module 32, possibly in cooperation with functional units 35 and 33. The processing module 32 may thus be arranged to fetch instructions from the memory module 35 as provided by a functional module 32*a-c* and to execute these instructions, thereby performing any steps as disclosed herein in FIG. 2.

Figure 7:
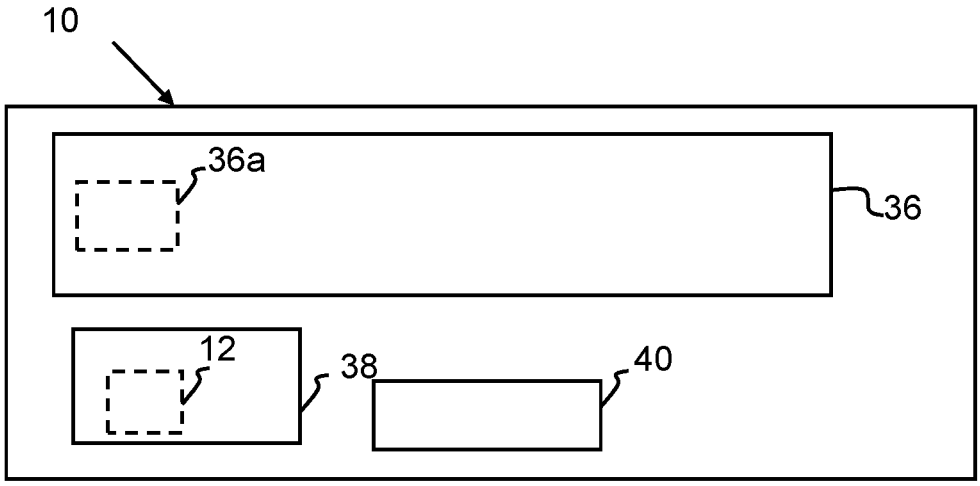

FIG. 7 schematically illustrates an exemplary user accessory device 10 according to this disclosure. The user accessory device 10 comprises a processing unit 36, a memory unit 38, and an interface 40. The user application 12 may be installed in the memory unit 38 of the user accessory device 10.

The user accessory device 10 or the interface 40 is configured to receive one or more of a configuration verification package, a configuration authentication package, and a configuration package from the server device. The configuration verification package may comprise an integrity indicator set and a first digital signature. The configuration authentication package may comprise a second digital signature. The configuration package comprises a configuration payload block and a control block.

The user accessory device 10 or the processing unit 36 is configured to determine if a verification criterion is fulfilled, wherein the verification criterion is based at least on one of the configuration verification package, the configuration authentication package, and the configuration package.

The user accessory device 10 or the interface 40 is configured to transmit the configuration authentication package and/or the configuration package to the hearing device, e.g. via communication link 20, if the verification criterion is fulfilled.

In one or more exemplary user accessory devices, the configuration authentication package comprises a second digital signature; and the verification criterion comprises a first verification criterion based on verifying the second digital signature using the processing unit 36. In one or more exemplary user accessory devices, the verification criterion is not fulfilled if the first verification criterion is not fulfilled.

In one or more exemplary user accessory devices, the configuration verification package comprises an integrity indicator set and/or a first digital signature, and the verification criterion comprises a second verification criterion comprising a second primary verification criterion and a second secondary verification criterion. The integrity indicator set may comprise a first integrity indicator, a second integrity indicator and optionally a third integrity indicator. The second primary verification criterion may be based on verifying the first digital signature using the processing unit 36, such as using the configuration public key. The second secondary verification criterion may be based on verifying the integrity indicator set using the processing unit 36, e.g. based on the configuration payload block and the control block, by e.g. calculating a first configuration data integrity indicator over the configuration payload block and comparing the calculated first configuration data integrity indicator with the received first integrity indicator of the integrity indicator set and/or by calculating a second configuration data integrity indicator over the control block and comparing the calculated second configuration data integrity indicator with the received second integrity indicator of the integrity indicator set. The verification criterion may not be fulfilled if the second primary verification criterion or the second secondary verification criterion is not fulfilled.

In one or more exemplary user accessory devices, the configuration verification package and/or the configuration authentication package comprise a hearing device identifier and/or an address identifier. The verification criterion may comprise a third verification criterion based on the received hearing device identifier corresponding to a hearing device identifier of the hearing device associated with the user accessory, such as based on verifying using the processing unit 36 whether the received hearing device identifier corresponds to the hearing device identifier of the hearing device associated with the user accessory. Alternatively or additionally, the verification criterion may comprise a fourth verification criterion based on the received address identifier corresponding to an address identifier of the hearing device associated with the user accessory, e.g. based on verifying using the processing unit 36 whether the received address identifier corresponds to an address identifier of the hearing device associated with the user accessory. The verification criterion may not be fulfilled if the third verification criterion or the fourth verification criterion is not fulfilled.

The user accessory device 10 or the processing unit 36 is arranged to execute methods for remote configuration of the hearing device 8 as disclosed herein (e.g. in FIG. 3). The user accessory device 10 or the processing unit 36 may further comprise a number of optional functional modules, such as any of a determine module 36*a* configured to perform steps S202 and optionally steps S202*a-e*. The functionality of module 36*a* is disclosed in the context of which the functional modules 36*a* may be used in FIG. 3 and accompanying text. In general terms, functional module 36*a* may be implemented in hardware or in software. Preferably, functional module 36*a* may be implemented by the processing module 36, possibly in cooperation with functional units 38 and 40. The processing module 36 may thus be arranged to fetch instructions from the memory module 38 as provided by a functional module 32*a* and to execute these instructions, thereby performing any steps as disclosed herein in FIG. 3.

The use of the terms "first", "second", "third" and "fourth", etc. does not imply any particular order, but are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element and vice versa.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

1 hearing system
2 fitting device
4 server device
6 hearing device system
8 hearing device
10 user accessory device
12 user application
20 communication link between user accessory device and hearing device
21 communication link between server device and user accessory device
22 communication link between fitting device and server device
23 communication link between fitting device and hearing device system
24 antenna
26 radio transceiver
28 first microphone
30 second microphone
32 processor
32*a* determine module
32*b* update module
33 interface
34 receiver
35 memory unit
36 processing unit
36*a* determine module
38 memory unit
40 interface
100 method performed in the hearing device
200 method performed in the user accessory device or the user application
402 configuration package
403 configuration package data
404 configuration payload block
406 configuration control block
408 configuration data
409 configuration data integrity indicator
412 configuration verification package
414 first integrity indicator
416 second integrity indicator
418 first digital signature
419 configuration block
502 configuration authentication package
504 configuration authentication material
506 dispenser certificate
508 second digital signature

The invention claimed is:

1. A method for updating a hearing device configuration of a hearing device, comprising:

receiving a configuration package and a configuration authentication package, the configuration authentication package comprising a dispenser certificate, wherein the configuration authentication package is generated by a server based on an input from a hearing aid fitting device;

determining if an update criterion is fulfilled, wherein the act of determining comprises verifying the configuration authentication package; and updating the hearing device configuration based on the configuration package if the update criterion is fulfilled.

2. The method according to claim 1, wherein the configuration package and the configuration authentication package are received from a user accessory device.

3. The method according to claim 1, wherein the act of determining if the update criterion is fulfilled comprises verifying the dispenser certificate.

4. The method according to claim 3, wherein the act of verifying the dispenser certificate comprises decrypting the dispenser certificate using a certificate key.

5. The method according to claim 3, wherein the configuration authentication package further comprises authentication data; and wherein the act of verifying the dispenser certificate comprises comparing one or more elements of the authentication data with corresponding element(s) of the dispenser certificate, and wherein the act of verifying the dispenser certificate fails if at least one of the one or more elements of the authentication data does not match the corresponding element of the dispenser certificate.

6. The method according to claim 5, wherein the act of verifying the dispenser certificate comprises decrypting the dispenser certificate using a certificate key, and wherein the act of comparing the one or more elements of the authentication data with the corresponding element(s) of the dispenser certificate comprises comparing the one or more elements of the authentication data received in plain text with the corresponding element(s) of the decrypted dispenser certificate.

7. The method according to claim 3, wherein the act of verifying the dispenser certificate comprises determining if the hearing aid fitting device and/or a dispenser is blacklisted.

8. The method according to claim 1, wherein the act of updating the hearing device configuration based on the configuration package comprises decrypting the configuration package using a configuration session key.

9. The method according to claim 1, wherein the configuration package comprises a configuration data integrity indicator, and wherein the act of updating the hearing device configuration comprises verifying the configuration data integrity indicator; and wherein the method further comprises terminating the act of updating if the act of verifying the configuration data integrity indicator fails.

10. The method according to claim 1, wherein the hearing device is a hearing aid.

11. A method, performed at a user accessory device, for remote configuration of a hearing device, the method comprising:

receiving two or more of: a configuration verification package, a configuration authentication package, and a configuration package, wherein the configuration package comprises a configuration payload block and a control block, and wherein the configuration package is for updating the hearing device;

determining if a verification criterion is fulfilled based on the configuration verification package, the configuration authentication package, the configuration package, or any combination of the foregoing; and transmitting the configuration authentication package, the configuration package, the configuration package, or any combination of the foregoing, to the hearing device if the verification criterion is fulfilled;

wherein the configuration authentication package and/or the configuration package is generated based on a collaboration between a hearing aid fitting device and a server controllable by a hearing device manufacturer, and wherein the configuration authentication package is generated by the server based on an input from the hearing aid fitting device.

12. The method according to claim 11, wherein the configuration authentication package comprises a digital signature; and wherein the act of determining if the verification criterion is fulfilled is performed based on the digital signature.

13. The method according to claim 11, wherein the configuration verification package comprises an integrity indicator set and/or a digital signature, and wherein the act of determining if the verification criterion is fulfilled comprises:

verifying the digital signature; and/or verifying the integrity indicator set.

14. The method according to claim 11, wherein the configuration verification package and/or the configuration authentication package comprise a hearing device identifier and/or an address identifier, and wherein the act of determining if the verification criterion is fulfilled comprises:

performing a first verification based on the hearing device identifier, the hearing device identifier associated with the hearing device; and/or performing a second verification based on the address identifier, the address identifier associated with the hearing device.

15. The method according to claim 11, wherein the hearing device comprises a hearing aid.

16. A hearing device comprising:

a processor configured to compensate for a hearing loss of a user based on a hearing device configuration;

wherein the hearing device is configured to update the hearing device configuration based on a configuration package if an update criterion is fulfilled based on a configuration authentication package received from an accessory device;

wherein the configuration authentication package comprises a dispenser certificate; and wherein the configuration authentication package is generated by a server based on an input from a hearing aid fitting device.

17. A program product having a processor-readable non-transitory medium storing a set of instructions, an execution of which by a processing unit of a user accessory device causes a method to be performed, the method comprising:

receiving two or more of: a configuration verification package, a configuration authentication package, and a configuration package, wherein the configuration package comprises a configuration payload block and a control block, and wherein the configuration package is for updating a hearing device;

determining if a verification criterion is fulfilled based on the configuration verification package, the configuration authentication package, the configuration package, or any combination of the foregoing; and transmitting the configuration authentication package, the configuration package, the configuration package, or any combination of the foregoing, to the hearing device if the verification criterion is fulfilled;

wherein the configuration authentication package and/or the configuration package is generated based on a collaboration between a hearing aid fitting device and a server controllable by a hearing device manufacturer, and wherein the configuration authentication package is generated by the server based on an input from the hearing aid fitting device.

18. The method according to claim 1, wherein the server is controllable by a hearing device manufacturer.

19. The method according to claim 1, wherein the act of receiving, and the act of determining if the update criterion is fulfilled, are performed by the hearing device.

20. The hearing device according to claim 16, wherein the server is controllable by a hearing device manufacturer.

21. The hearing device according to claim 16, wherein the hearing device is configured to receive the configuration package and the configuration authentication package.

* * * * *